US008646555B2

(12) United States Patent
Reed

(10) Patent No.: US 8,646,555 B2
(45) Date of Patent: Feb. 11, 2014

(54) COOLING SYSTEM APPARATUS FOR A VEHICLE

(75) Inventor: Camas Elaine Reed, Columbus, OH (US)

(73) Assignee: Honda Motor Company, Ltd., Tokyo (JP)

( * ) Notice: Subject to any disclaimer, the term of this patent is extended or adjusted under 35 U.S.C. 154(b) by 526 days.

(21) Appl. No.: 12/946,221

(22) Filed: Nov. 15, 2010

(65) Prior Publication Data

US 2012/0118527 A1 May 17, 2012

(51) Int. Cl.
*B60K 11/00* (2006.01)

(52) U.S. Cl.
USPC ..... 180/68.4

(58) Field of Classification Search
USPC ..... 180/68.4, 68.6; 165/41, 73; 123/41.49, 123/41.55
See application file for complete search history.

(56) References Cited

U.S. PATENT DOCUMENTS 3,692,004 A * 9/1972 Tangue et al. ..... 123/41.57
4,441,463 A 4/1984 Rest et al.
4,744,433 A * 5/1988 Takeuchi et al. ..... 180/68.4
4,953,631 A * 9/1990 Kimura ..... 165/41
5,649,587 A 7/1997 Plant
5,662,072 A * 9/1997 Suzuki et al. ..... 123/41.14
5,850,872 A * 12/1998 Cesaroni ..... 165/41
5,971,062 A 10/1999 Sadr et al.
6,041,744 A 3/2000 Oota et al.
6,360,815 B1 * 3/2002 Vadrot et al. ..... 165/121
6,516,906 B2 * 2/2003 Sasano et al. ..... 180/68.4
6,547,019 B2 * 4/2003 Maeda et al. ..... 180/68.4
6,908,283 B2 6/2005 Soofer et al.
6,951,240 B2 * 10/2005 Kolb ..... 165/42
6,997,239 B2 * 2/2006 Kato ..... 165/41
7,040,260 B2 * 5/2006 Yoshimatsu et al. ..... 123/41.65
7,137,439 B2 11/2006 Hoshino
7,743,862 B2 * 6/2010 Togawa et al. ..... 180/68.4
2006/0048924 A1 3/2006 Desai
2008/0289796 A1 * 11/2008 Sasano et al. ..... 165/51

* cited by examiner

*Primary Examiner* — Katy M Ebner
(74) *Attorney, Agent, or Firm* — Ulmer & Berne LLP

(57) ABSTRACT

A cooling system apparatus for a vehicle includes a reserve tank and a plurality of legs extending outwardly from the reserve tank. The reserve tank defines a chamber and each of the legs is configured for attachment to a radiator of a vehicle. The reserve tank and the legs are integrally formed as a unitary structure.

16 Claims, 7 Drawing Sheets

COOLING SYSTEM APPARATUS FOR A VEHICLE

TECHNICAL FIELD

The invention relates generally to cooling systems, and more particularly to cooling systems for vehicles.

BACKGROUND

Vehicles using internal combustion engines as a source of motive power often include cooling systems to pump cooling fluid, e.g., ethylene glycol, through a block of the engine to absorb heat and prevent problems such as engine overheating and seizure. Conventional cooling systems in vehicles of this type include those having an air-cooled radiator to remove heat from the cooling fluid after it discharges from the engine block, and a separate reserve tank for the cooling fluid, with the radiator and reserve tank being in fluid communication via a flexible hose. As the cooling fluid is heated and cooled, it expands and contracts, which results in variation of a level of cooling fluid within the reserve tank.

As the vehicle moves forward, ambient air impacts the front of the radiator, which cools the cooling fluid within the radiator. The process of removing heat from the cooling fluid can be accelerated, at least during selected vehicle operating conditions, by operating a fan that is positioned adjacent to the radiator.

SUMMARY

According to one embodiment, a cooling system apparatus for a vehicle is provided. The cooling system apparatus includes a reserve tank and a plurality of legs extending outwardly from the reserve tank. The reserve tank defines a first chamber. Each of the legs is configured for attachment to a radiator of a vehicle. The reserve tank and the legs are integrally formed as a unitary structure.

According to another embodiment, a cooling system for a vehicle is provided. The cooling system includes a radiator, a fan blade assembly, a fan motor coupled to the fan blade assembly and operable for rotating the blade assembly, a reserve tank and a plurality of legs extending outwardly from the reserve tank. Each of the legs is attached to the radiator. The radiator defines a first chamber and the reserve tank defines a second chamber in fluid communication with the first chamber. The reserve tank and the legs are integrally formed as a unitary structure and the fan motor is attached to the unitary structure.

According to another embodiment, a vehicle is provided that includes a frame and a cooling system supported by the frame. The cooling system includes a radiator, a fan blade assembly, a fan motor coupled to the fan blade assembly and operable for rotating the fan blade assembly, and a cooling apparatus comprising a reserve tank and a plurality of legs extending outwardly from the reserve tank. The radiator defines a first chamber and the reserve tank defines a second chamber in fluid communication with the first chamber. The fan motor is attached to the cooling apparatus and at least one of the legs is attached to the radiator. The reserve tank and the legs are integrally formed as a unitary structure.

BRIEF DESCRIPTION OF THE DRAWINGS

Various embodiments will become better understood with regard to the following description, appended claims and accompanying drawings wherein:

DETAILED DESCRIPTION

Figure 1:
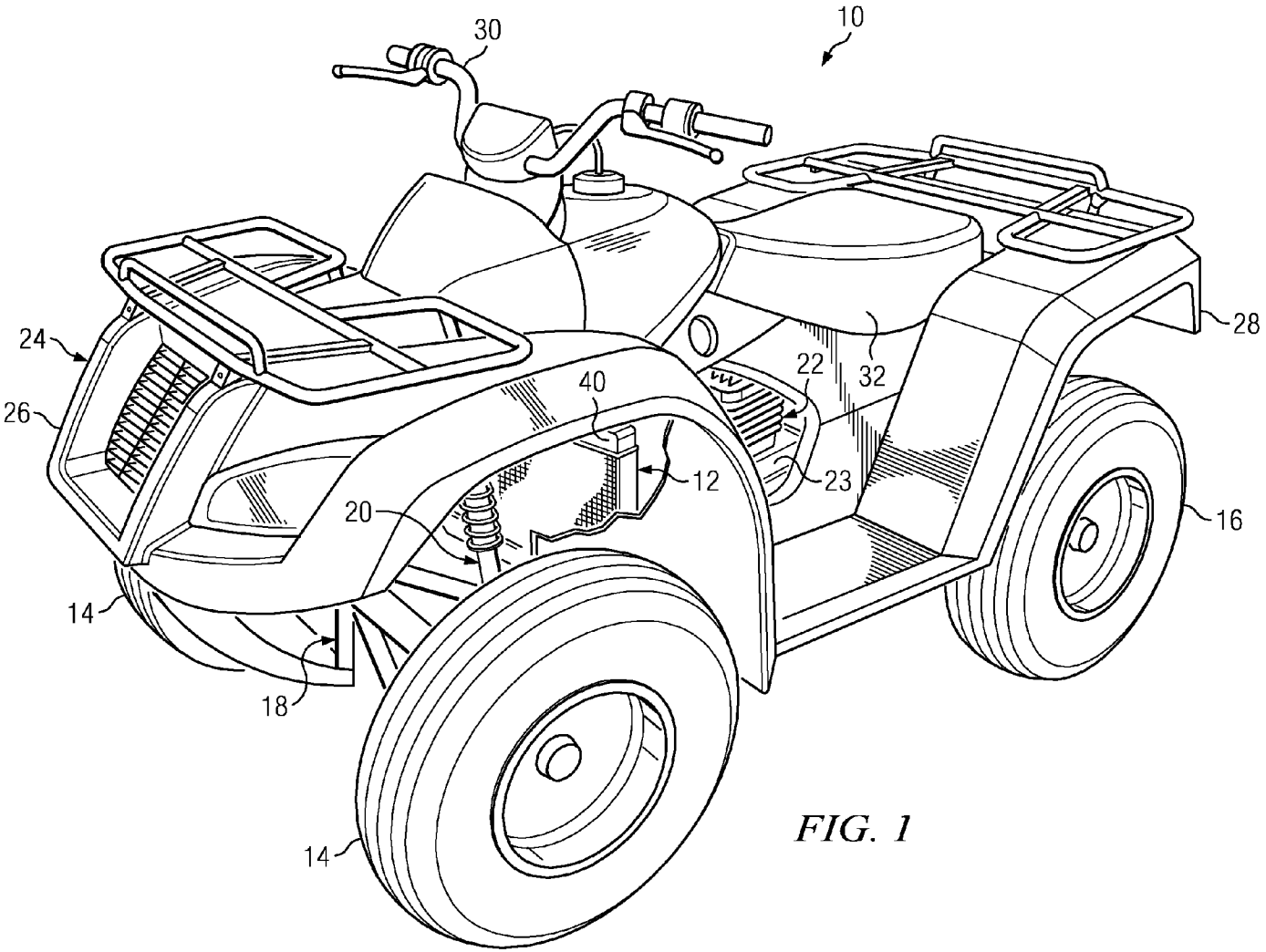
FIG. 1 is a perspective view of a vehicle that includes a cooling system according to one embodiment, with a portion of the left front fender assembly of the vehicle not shown to illustrate a portion of the cooling system.

FIG. 1 illustrates a saddle-type vehicle 10 that can include a cooling system, indicated generally at 12, according to one embodiment. The saddle-type vehicle 10 is shown to be an all terrain vehicle (ATV). However, cooling systems can be provided that can be used with other saddle-type vehicles, or with a variety of other types of land, water or other vehicles.

Vehicle 10 can include two rotatable front wheels 14 and two rotatable rear wheels 16 (one shown). The front wheels 14 and rear wheels 16 can be suspended from a frame 18 and can be rotatable relative to frame 18. The front wheels 14 can be suspended from frame 18 using any of a variety of conventional suspension systems, such as suspension system 20 shown partially in FIG. 1. Vehicle 10 can further include a source of motive power 22, which is shown to be an internal combustion engine in FIG. 1. In other embodiments, cooling systems can be provided in association with other suitable sources of motive power, e.g., one or more electric motors, or in association with other components of a motor vehicle that require cooling, e.g., transmissions, gearboxes, batteries and power steering systems. The source of motive power 22 can be coupled to the front wheels 14 and/or the rear wheels 16. For example, the source of motive power 22 can be drivingly coupled to a drivetrain (not shown) that can be operable for transferring torque to the front wheels 14 and/or the rear wheels 16.

Vehicle 10 can also include a body 24 that can be supported by frame 18. The body 24 can include a front fender assembly 26 and a rear fender assembly 28. As shown in FIG. 1 with respect to the left front wheel 14 and the left rear wheel 16, the front fender assembly 26 can be adjacent to and at least partially cover each of the front wheels 14, and the rear fender assembly 28 can be adjacent to and at least partially cover each of the rear wheels 16. Vehicle 10 can further include a handlebar assembly 30 coupled to the front wheels 14, which can be used by an operator of vehicle 10 to facilitate steering the front wheels 14. Vehicle 10 can further include a seat 32 that can be used to support an operator of vehicle 10.

Figure 2:
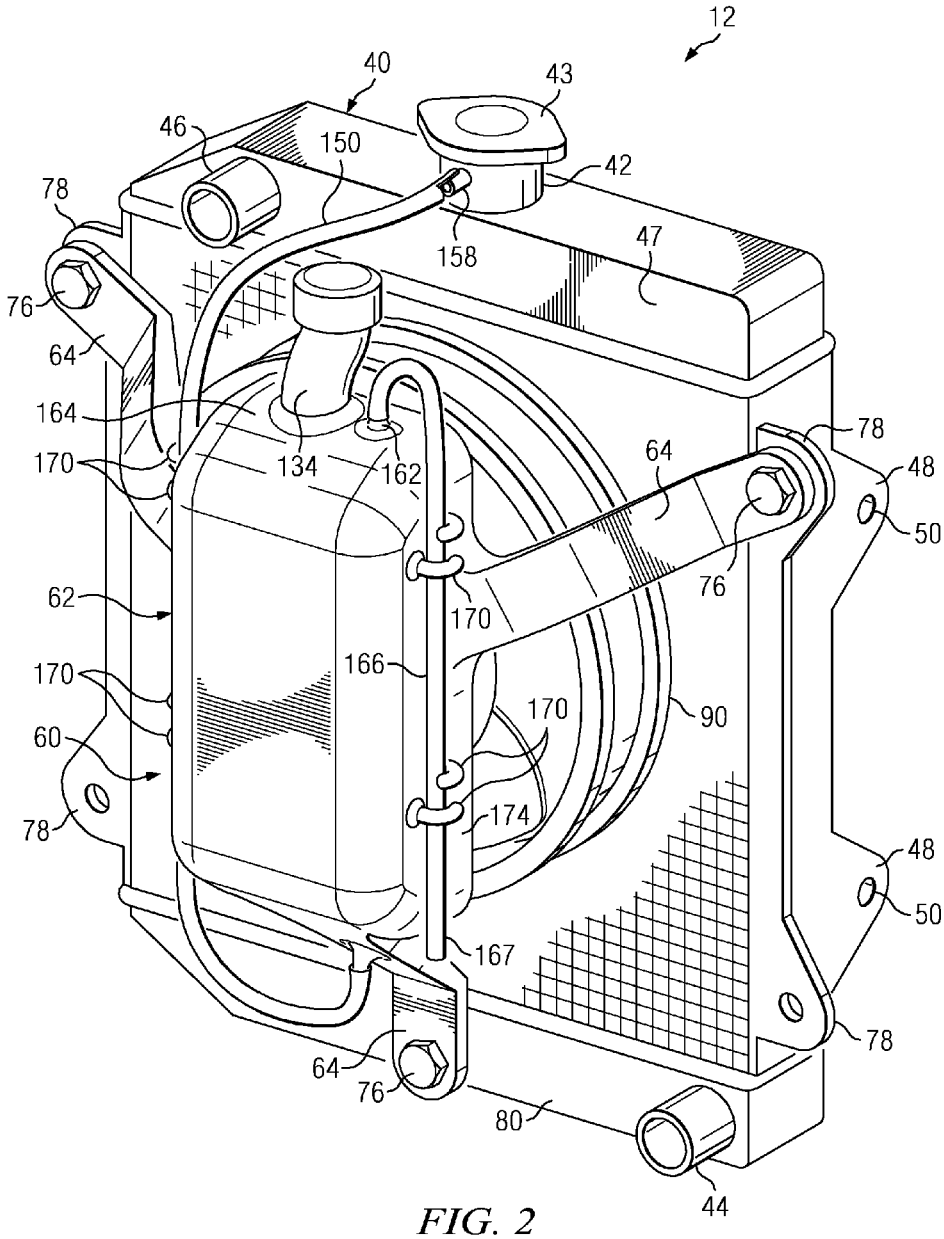
FIG. 2 is a rear perspective view of the cooling system of FIG. 1, wherein a portion of an included conduit is partially broken away for purposes of illustration.
Figure 7:
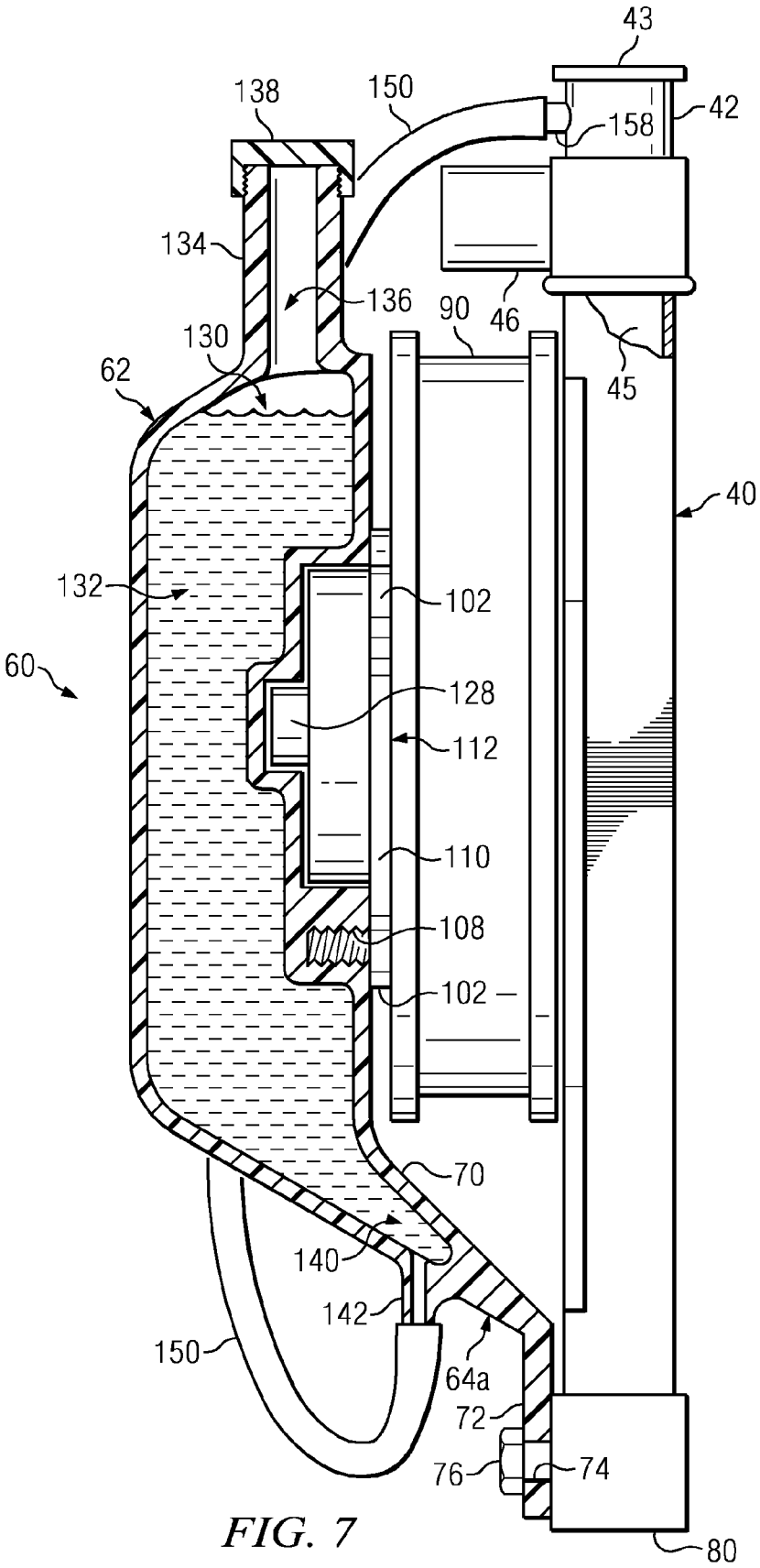
FIG. 7 is a cross-sectional view taken along line 7-7 in FIG. 4 and in association with the fan motor, a fan blade assembly, and a radiator of the cooling system shown in FIG. 2.

Referring to FIG. 2, the cooling system 12 can include a radiator 40 that can be attached, either directly or indirectly, to the frame 18. The radiator 40 can include an inlet port 42 and a fill cap 43 that can be removably secured to the inlet port 42. The inlet port 42 can define a passageway (not shown). When fill cap 43 is removed, cooling fluid, e.g., ethylene glycol, can be poured into and through the passageway defined by inlet port 42 into a chamber 45 (FIG. 7) defined by radiator 40. Radiator 40 can be configured in any suitable manner known in the art to permit cooling fluid to flow through radiator 40, from chamber 45 to an outlet port 44, and to facilitate cooling the cooling fluid as it flows through radiator 40 during operation of vehicle 10.

The cooling fluid can discharge from the radiator 40 through the outlet port 44. The source of motive power 22 can include a block shown generally at 23 in FIG. 1, and the outlet port 44 of radiator 40 can be in fluid communication with fluid passages (not shown) defined by the block in any suitable manner, e.g., via one or more conduits (not shown) and a pump (not shown). The cooling fluid can flow through the block 23 of the source of motive power 22, and can cool the source of motive power 22, during operation of vehicle 10. Cooling fluid discharging from the block of the source of motive power 22 can flow through one or more suitable fluid flow components, e.g., one or more conduits (not shown) to a return port 46 of radiator 40.

Radiator 40 can include a plurality of forward mount flanges 48 (two shown) which can be used to attach radiator 40, either directly or indirectly, to frame 18. For example, radiator 40 can include two or more of the forward mount flanges 48 protruding from each side of radiator 40. Each forward mount flange 48 can include one or more apertures 50, and a male fastener (not shown) can be inserted through a respective aperture 50 and a mating aperture (not shown) in frame 18 or a mating aperture in a structure, such as a bracket, secured to frame 18. Such male fasteners can be secured with female fasteners or can be secured using threaded apertures in frame 18 or in a structure secured to frame 18.

Cooling system 12 can further include an apparatus 60 that can be attached to the radiator 40. Apparatus 60 can include a reserve tank 62 and a plurality of legs 64 extending outwardly from the reserve tank 62. The reserve tank 62 and each of the legs 64 can be integrally formed as a unitary structure. In one embodiment, the reserve tank 62 and the legs 64 can be molded, using any suitable molding process, e.g., blow molding. The reserve tank 62 and the legs 64 can be formed from a polymeric material, which can be a thermoplastic material. Suitable polymeric materials include, but are not limited to, polyethylene and polypropylene.

Each of the legs 64 can include a proximal end portion 70 (FIG. 3) that can be integral with the reserve tank 62 and can further include a distal end portion 72 (FIG. 3) that can be configured for attachment to the radiator 40. For example, the distal end portion 72 of each leg 64 can define an aperture 74 that can be sized and configured to receive a male fastener, e.g., bolt 76 (FIG. 2). Each bolt 76 can be inserted through a respective one of the apertures 74 and into a mating and aligned aperture (not shown) defined by radiator 40, e.g., an aperture defined by one of a plurality of rear mount flanges 78 of radiator 40 or an aperture defined by a bottom portion 80 of radiator 40. Each bolt 76 can be secured by a respective female fastener (not shown), e.g., a nut, or alternatively each bolt 76 can be threaded into a mating aperture of radiator 80 having internal threads. The cooling apparatus 60 is shown in FIG. 2 to be attached to a rear side 47 of radiator 40. However, in other embodiments cooling apparatus can be provided that include a reserve tank and a plurality of legs integrally formed with the reserve tank as a unitary structure, which can be attached to a front side of a radiator.

Figure 3:
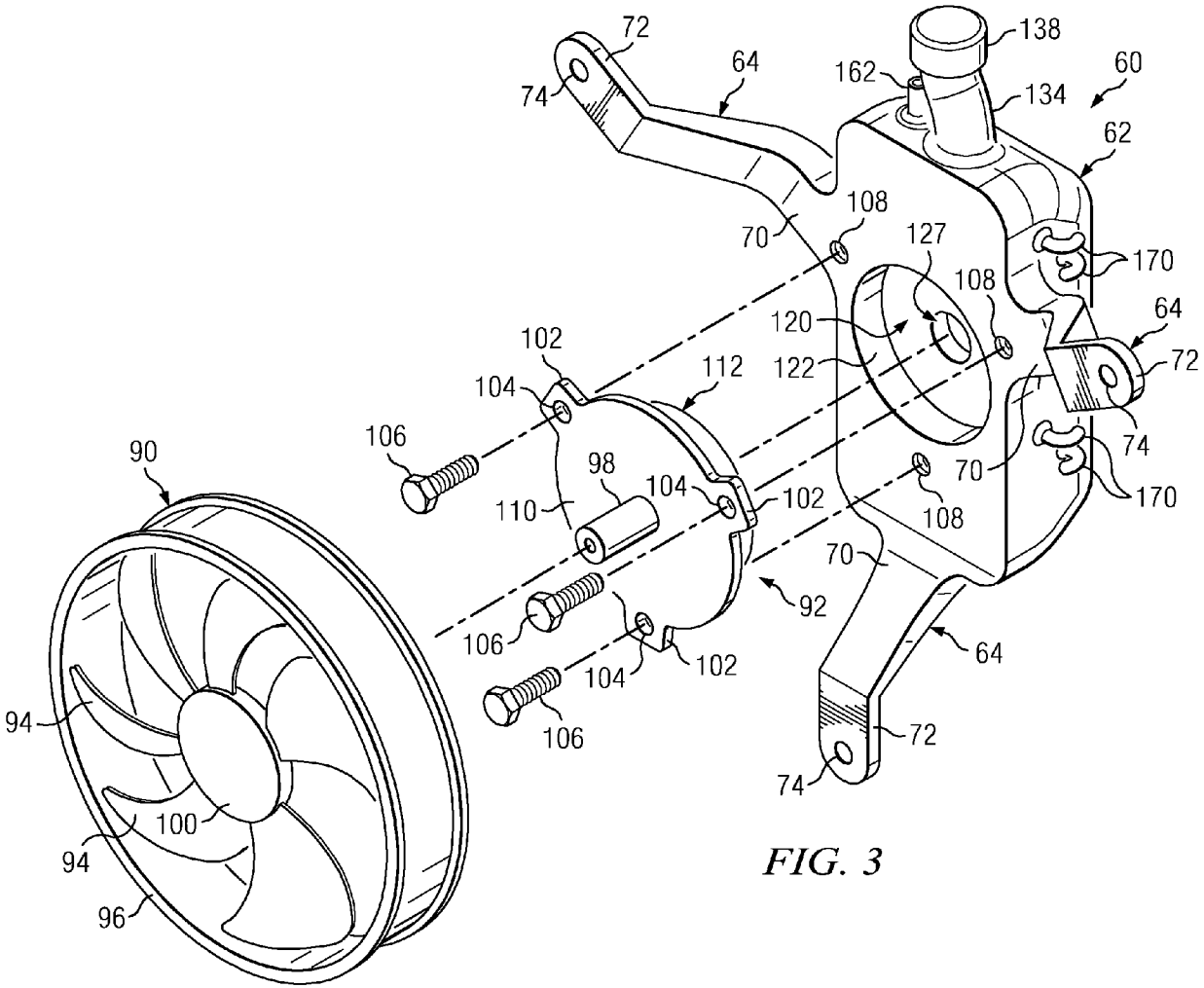
FIG. 3 is a front exploded assembly view of a portion of the cooling system shown in FIG. 2.
Figure 5:
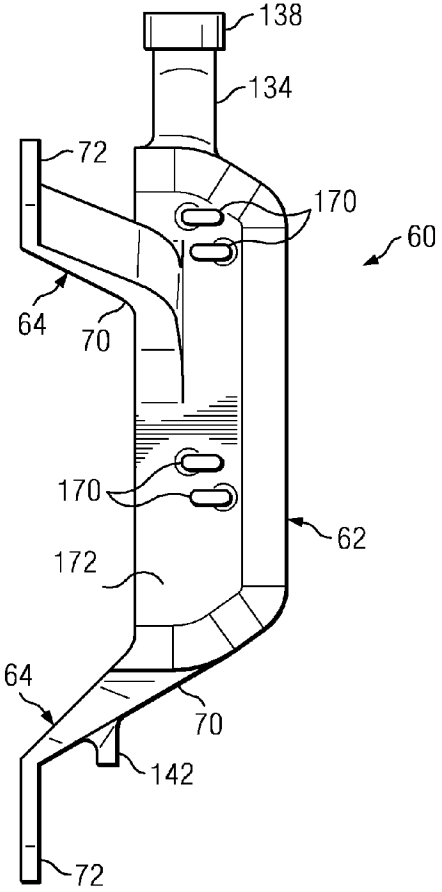
FIG. 5 is a side elevation view of the portion of the cooling system shown in FIG. 4.

As shown in FIG. 3, the cooling system 12 can also include a fan blade assembly 90 and a fan motor 92. The fan blade assembly 90 can include a hub 100 and a plurality of fan blades 94 that can extend radially outwardly from the hub 100. The fan blade assembly 90 can also include an annular fan casing 96, and a radially outer end of each of the fan blades 94 can be secured to the fan casing 96. The fan motor 92 can be coupled to the fan blade assembly 90. For example, the fan motor 92 can include a rotatable output shaft 98 that can be drivingly coupled to the hub 100 of the fan blade assembly 90, such that the fan motor 92 can be operable for rotating the fan blade assembly 90. A fan blade assembly can be provided in any of a variety of suitable alternative shapes and configurations.

The fan motor 92 can be attached to the reserve tank 62 and/or to one or more of the legs 64 of the apparatus 60. The fan motor 92 can include a plurality of mount tabs 102, with each mount tab 102 defining an aperture 104 that can be sized and configured to receive a male fastener, e.g., bolt 106. Each bolt 106 can be secured to apparatus 60. For example, each bolt 106 can be threaded into a threaded aperture 108 defined by reserve tank 62. In other embodiments, each bolt 106 can be secured to a respective one of the legs 64, e.g., by threading each bolt 106 into a threaded aperture (not shown) defined by a respective one of the legs 64. In other embodiments, one or more of the bolts 106 can be threaded into a mating aperture defined by the reserve tank 62, e.g., aperture 108, and one or more of the bolts 106 can be threaded into an aperture defined by a respective one of the legs 64. The mount tabs 102 can extend outwardly from a base portion 110 of a housing 112 of the fan motor 92. The mount tabs 102 can extend generally radially outwardly from the base portion 110 as shown in FIG. 3.

Figure 6:
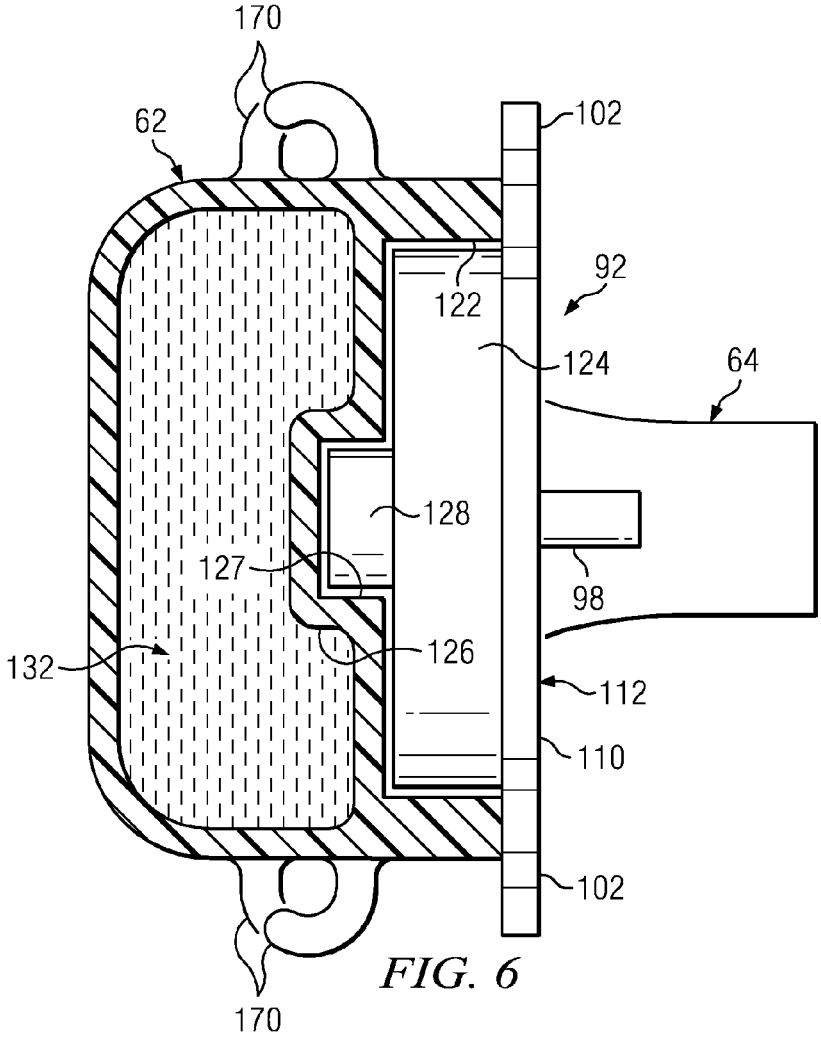
FIG. 6 is a cross-sectional view taken along line 6-6 in FIG. 4 and in association with a fan motor of the cooling system shown in FIG. 2.

The reserve tank 62 of apparatus 60 can define an open cavity 120 and at least a portion of the fan motor 92 can be disposed within cavity 120. Referring to FIGS. 3 and 6, the reserve tank 62 can include a generally cylindrical surface 122 that can at least partially define the cavity 120, and that can surround, or at least partially surround, a generally cylindrical portion 124 of housing 112 of fan motor 92 that can be disposed within cavity 120. The reserve tank 62 can include a recessed portion 126 that can define a cavity 127 that can communicate with cavity 120 and that can be sized and configured such that a protruding portion 128 of housing 112 of fan motor 92 can be disposed within cavity 127. The protruding portion 128 of housing 112 can be integral with, and can extend from, the generally cylindrical portion 124 of housing 112. One end of the output shaft 98 of fan motor 92 can be journalled within the protruding portion 128 of housing 112.

The reserve tank 62 can define a chamber 130 (FIG. 7) that can be configured to receive and contain a cooling fluid 132, e.g., ethylene glycol. The reserve tank 62 can include an inlet port 134 that can define a passageway 136 that can be in fluid communication with the chamber 130. A cap 138 can be removably secured to the inlet port 134. In one embodiment, cap 138 and inlet port 134 can have mating threads (not shown). When cap 138 is removed from inlet port 134, a fluid, e.g., cooling fluid 132, can be poured into and through passageway 136 into chamber 130.

One or more of the legs 64 can be at least partially hollow to supplement the capacity of cooling apparatus 60 to contain cooling fluid. In one embodiment, a bottom one of the legs 64, identified as **64*a* in FIG. 7, can be at least partially hollow and can define a chamber 140. Chamber 140 can be in fluid communication with chamber 130 defined by the reserve tank 62. The bottom leg 64*a* can include an outlet port 142 that can at least partially define chamber 140. The outlet port 142 can be open at a lower end, which allows cooling fluid 132 within chambers 130 and 140 to discharge from cooling apparatus 60 through the outlet port 142**.

Radiator 40 can also include an overflow port 158 that can be secured to the inlet port 42. Overflow port 158 can define a passageway (not shown) that can be in fluid communication with the passageway (not shown) defined by the inlet port 42, such that fluid can flow through the overflow port 158, either to or from the interior chamber 45 defined by radiator 40. A conduit 150, which can be a flexible conduit, can be attached at one end to the outlet port 142 of the bottom leg 64*a* and can be attached at the other end to the overflow port 158, such that chambers 130 and 140 of the cooling apparatus 60 can be in fluid communication with the chamber 45 defined by radiator 40. This end of conduit 150 is partially broken away in FIG. 2 to reveal the overflow port 158.

Figure 4:
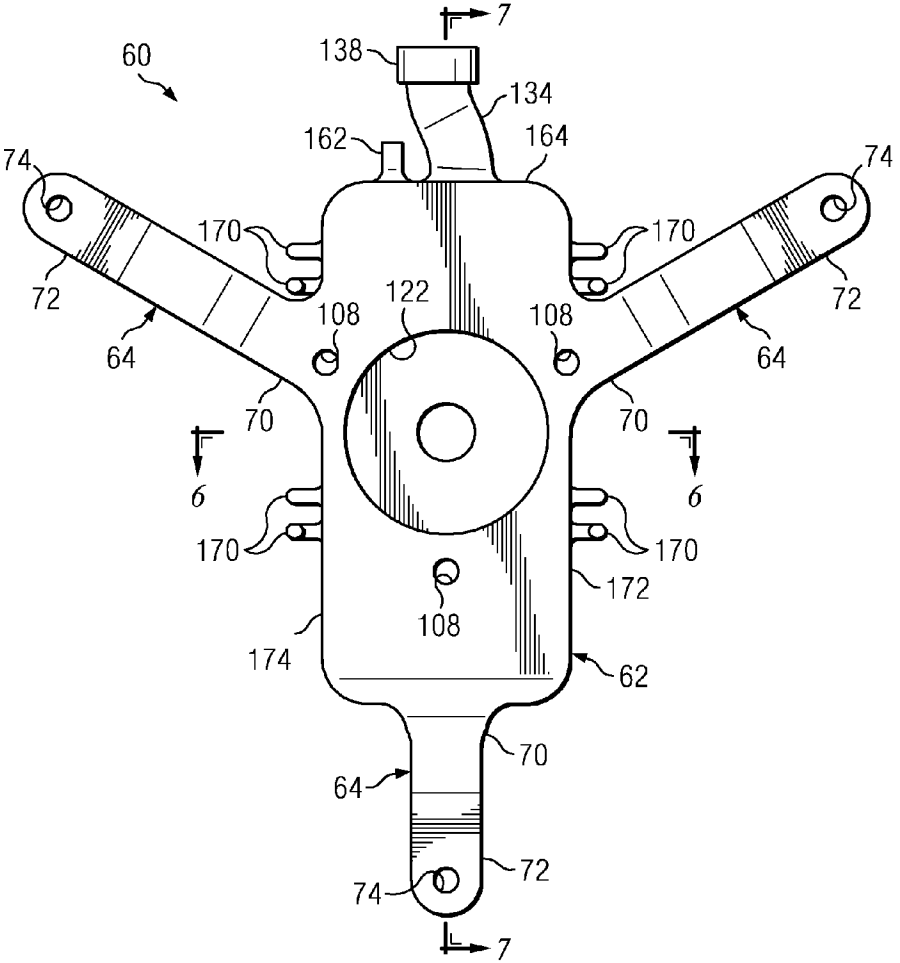
FIG. 4 is a front elevation view of a portion of the cooling system shown in FIG. 2.

The reserve tank 62 can further include a vent 162 that can protrude from an upper end 164 of the reserve tank 62, as shown in FIGS. 2 and 4. The vent 162 can be a hollow nipple that defines a passageway (not shown) that can be in fluid communication with the chamber 130 defined by the reserve tank 62. A conduit 166 (FIG. 2), which can be a flexible conduit, can be attached at one end to the vent 162 such that any fluid that discharges from the vent 162 can flow through the conduit 166, which can have a lower end 167 directed toward a ground surface (not shown). In an alternative embodiment, a vent cap (not shown) can be provided that can be configured, and can include a one-way permeable material e.g., Gore-Tex®, to permit fluid to flow from chamber 130 outward through the material but prevent, or at least substantially prevent, fluid from flowing through the material into chamber 130.

Referring to FIGS. 2-5, reserve tank 62 can include a plurality of tabs 170. A first plurality of the tabs 170 can protrude outwardly from a first side 172 of the reserve tank 62, and a second plurality of the tabs 170 can protrude outwardly from a second side 174 of the reserve tank 62. The tabs 170 that protrude outwardly from the first side 172 of the reserve tank 62 can releasably secure the conduit 150 to reserve tank 62. The tabs 170 that protrude outwardly from the second side 174 of reserve tank 62 can releasably secure the conduit 166 to reserve tank 62.

Figure 8:
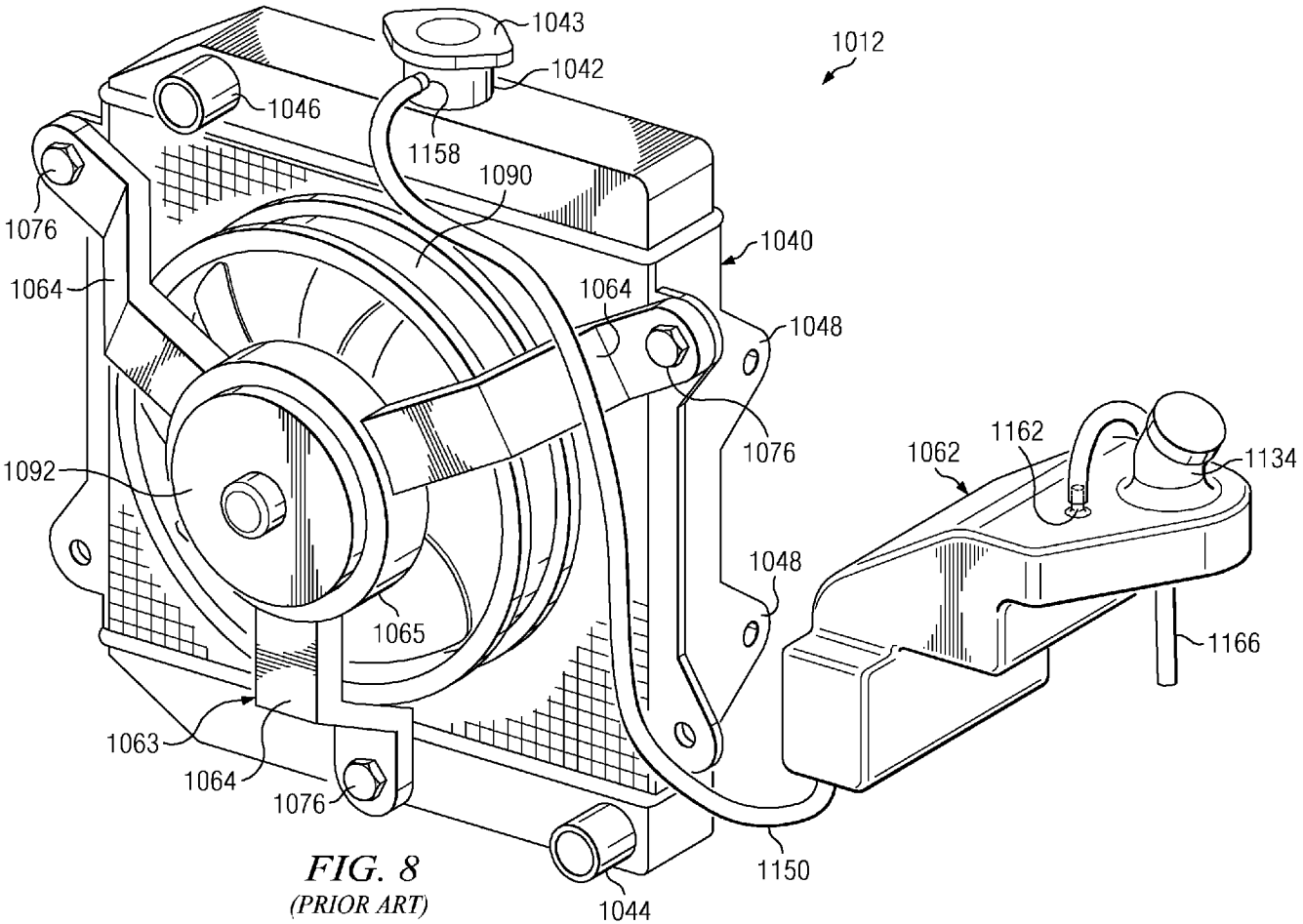
FIG. 8 (PRIOR ART)
FIG. 8 is a rear perspective view of a Prior Art cooling system.

Prior Art FIG. 8 illustrates a conventional cooling system 1012 that includes a radiator 1040 and a reserve tank 1062. The radiator 1040 includes an inlet port 1042, an outlet port 1044 and a return port 1046. Radiator 1040 further includes a plurality of mount flanges 1048 that are used to secure radiator 1040 to the frame of a vehicle, e.g., by using conventional fasteners. Radiator 1040 also includes an overflow port 1158 that is secured to the inlet port 1042. Overflow port 1158 defines a passageway (not shown) that is in fluid communication with a passageway (not shown) defined by the inlet port 1042. The passageway defined by the inlet port 1042 is in fluid communication with an interior chamber (not shown) defined by radiator 1040.

A fill cap 1043 is removably secured to the inlet port 1042. When fill cap 1043 is removed, coolant fluid, e.g., ethylene glycol, can be poured into and through the passageway defined by the inlet port 1042 into the chamber defined by the radiator 1040. A conduit 1150 is attached at one end to the overflow port 1158 of radiator 1040. The opposite end of conduit 1150 is attached to an outlet port (not shown) of the reserve tank 1062. During operation of a vehicle associated with the cooling system 1012, as cooling fluid within radiator 1040 is heated, the cooling fluid can expand such that a portion of the cooling fluid can flow through conduit 1150 and into the reserve tank 1062. As the cooling fluid cools, some of the cooling fluid can return from the reserve tank 1062 to radiator 1040 through conduit 1150. The reserve tank 1062 includes an inlet port 1134 and a vent 1162, and a conduit 1166 is attached at one end to the vent 1162.

Cooling system 1012 further includes a fan stay 1063, a fan blade assembly 1090 and a fan motor 1092. Fan blade assembly 1090 includes a plurality of fan blades and a fan casing surrounding the fan blades. The fan motor 1092 is coupled to the fan blade assembly 1090, e.g., a rotatable output shaft of the fan motor 1092 is coupled to a hub (not shown) of the fan blade assembly 1090, such that the fan motor 1092 is operable for rotating the fan blade assembly 1090.

The fan stay 1063 includes an inner annular hub 1065 and a plurality of legs 1064 that extend outwardly from the inner annular hub 1065. Each of the legs 1064 is attached to radiator 1040 with bolts 1076. The fan motor 1092 is attached to the fan stay 1063 using a plurality of conventional fasteners (not shown), such that the inner annular hub 1065 of fan stay 1063 surrounds a portion of the fan motor 1092, as shown in FIG. 8. The fan motor 1092 includes a plurality of mount tabs (not shown), with each mount tab defining an aperture that is sized and configured to receive a respective bolt (not shown). Each of the bolts is secured to the fan stay 1063, which releasably attaches the fan motor 1092 to the fan stay 1063. In conventional cooling system 1012, the reserve tank 1062 and fan stay 1063 are not manufactured integrally as a unitary structure. Instead, the reserve tank 1062 is manufactured separately from the fan stay 1063 and is typically positioned in an associated vehicle at a location spaced apart from the fan stay 1063, as shown generally in FIG. 8.

In contrast to the reserve tank 1062 and fan stay 1063 of conventional cooling system 1012, the reserve tank 62 and legs 64 of cooling apparatus 60 of cooling system 12 can be integrally formed, e.g., from a polymeric material, as a unitary structure, while maintaining the corresponding dual function of supporting the fan motor 92 and providing the reserve tank 62 to receive cooling fluid from a radiator of a vehicle, e.g., radiator 40 of vehicle 10, as the cooling fluid is heated during operation of a vehicle. Cooling fluid can be drawn into the radiator 40 from reserve tank 62 as the cooling fluid cools. Forming reserve tank 62 and legs 64 as a unitary structure can result in a reduced number of parts, reduced assembly time, and reduced weight, relative to conventional cooling systems such as cooling system 1012, wherein each of these reductions can result in a cost reduction relative to the use of a conventional cooling system, such as cooling system 1012.

While various embodiments of a cooling system apparatus for a vehicle, a cooling system for a vehicle, and a vehicle, have been illustrated by the foregoing description and have been described in considerable detail, it is not intended to restrict or in any way limit the scope of the appended claims to such detail. Additional modifications will be readily apparent to those skilled in the art.

What is claimed is:

1. A cooling system apparatus for a vehicle, the cooling system apparatus comprising:

a reserve tank defining a first chamber and a first cavity; and a plurality of legs extending outwardly from the reserve tank, each of the legs being configured for attachment to a radiator of a vehicle; wherein the reserve tank and the legs are integrally formed as a unitary structure;

a bottom one of the legs defines a second chamber in fluid communication with the first chamber;

the reserve tank comprises a recessed portion that defines a second cavity in communication with the first cavity;

the bottom one of the legs comprises an outlet port, the outlet port comprising a lower end, the lower end of the outlet port being open to allow cooling fluid within the first chamber and the second chamber to discharge through the outlet port; and each of the first cavity and the second cavity is configured to receive a respective portion of a housing of a fan motor.

2. The cooling system apparatus of claim 1, wherein:

each of the legs comprises a proximal end portion and a distal end portion;

the proximal end portion of each of the legs is integral with the reserve tank and, for each of the legs, the distal end portion defines an aperture configured to receive a male fastener to facilitate attaching the legs to a radiator; and the reserve tank defines at least one aperture configured to receive a male fastener to facilitate attaching a fan motor to the reserve tank.

3. The cooling system apparatus of claim 2, wherein:

the reserve tank comprises an inlet port, the inlet port defining a passageway in fluid communication with the first chamber; and the reserve tank further comprises a vent.

4. The cooling system apparatus of claim 2, wherein:

the reserve tank further comprises a generally cylindrical surface that at least partially defines the first cavity and is configured to surround the at least a portion of a fan motor.

5. The cooling system apparatus of claim 1, wherein:

the reserve tank and the legs are integrally formed from a polymeric material.

6. A cooling system for a vehicle, the cooling system comprising:

a radiator;

a fan blade assembly;

a fan motor coupled to the fan blade assembly and operable for rotating the fan blade assembly;

a reserve tank; and a plurality of legs extending outwardly from the reserve tank, each of the legs being attached to the radiator; wherein the radiator defines a first chamber and the reserve tank defines a second chamber in fluid communication with the first chamber;

the reserve tank and the legs are integrally formed as a unitary structure;

the fan motor is attached to the unitary structure;

the reserve tank defines at least one cavity;

at least a portion of the fan motor is disposed within the at least one cavity;

the at least one cavity comprises a first cavity and a second cavity in communication with the first cavity;

the reserve tank comprises a generally cylindrical surface and a recessed portion, the generally cylindrical surface at least partially defining the first cavity, the recessed portion defining the second cavity;

the fan motor comprises a rotatable output shaft drivingly coupled to the fan blade assembly and further comprises a housing, the housing comprising a generally cylindrical portion and a protruding portion integral with, and extending from, the generally cylindrical portion;

the generally cylindrical portion of the housing of the fan motor is disposed within the first cavity and is at least partially surrounded by the generally cylindrical surface of the reserve tank; and the protruding portion of the housing of the fan motor is disposed within the second cavity.

7. The cooling system of claim 6, wherein:

the plurality of legs comprises a bottom leg, the bottom leg defining a third chamber in fluid communication with the second chamber defined by the reserve tank and the first chamber defined by the radiator.

8. The cooling system of claim 7, further comprising:

a first conduit that facilitates fluid communication between the third chamber defined by the one of the legs and the first chamber defined by the radiator.

9. The cooling system of claim 8, wherein:

the bottom leg comprises an outlet port;

the radiator comprises an inlet port and an overflow port secured to the inlet port;

the first conduit comprises a first end attached to the outlet port of the one of the legs and a second end attached to the overflow port of the radiator; and the outlet port of the one of the legs, the first conduit, and the overflow port and the inlet port of the radiator cooperate to establish fluid communication between the third chamber defined by the one of the legs and the first chamber defined by the radiator.

10. The cooling system of claim 9, further comprising:

a second conduit; wherein the reserve tank comprises a vent;

the second conduit is attached, at one end thereof, to the vent; and the reserve tank and the legs are integrally formed from a polymeric material.

11. The cooling system of claim 7, wherein:

the one of the legs comprises a bottom leg.

12. A vehicle comprising:

a frame; and a cooling system supported by the frame, wherein the cooling system comprises:

a radiator, the radiator defining a first chamber;

a fan blade assembly;

a fan motor coupled to the fan blade assembly and operable for rotating the fan blade assembly; and an apparatus comprising a reserve tank and a plurality of legs extending outwardly from the reserve tank; wherein the reserve tank defines a second chamber in fluid communication with the first chamber;

at least one of the legs is attached to the radiator;

the reserve tank and the legs are integrally formed as a unitary structure;

the fan motor is attached to the unitary structure;

one of the legs defines a third chamber in fluid communication with the second chamber defined by the reserve tank and with the first chamber defined by the radiator;

the fan motor comprises a housing, the housing comprising a generally cylindrical portion and a protruding portion integral with, and extending from, the generally cylindrical portion;

the reserve tank comprises a generally cylindrical surface and a recessed portion;

the generally cylindrical surface of the reserve tank at least partially defines a first cavity and at least partially surrounds the generally cylindrical portion of the housing of the fan motor;

the recessed portion of the reserve tank defines a second cavity; and the second cavity is in communication with the first cavity, the protruding portion of the housing of the fan motor being disposed within the second cavity.

13. The vehicle of claim 12, further comprising:

a first conduit that facilitates fluid communication between the third chamber defined by the one of the legs and the first chamber defined by the radiator.

14. The vehicle of claim 13, wherein:

the first conduit comprises a first end and a second end;

the one of the legs comprises an outlet port;

the radiator comprises an inlet port and an overflow port secured to the inlet port; and the first end of the first conduit is attached to the outlet port of the one of the legs and the second end of the first conduit is attached to the overflow port of the radiator, such that the outlet port of the one of the legs, the first conduit, and the overflow port and the inlet port of the radiator cooperate to establish fluid communication between the third chamber defined by the one of the legs and the first chamber defined by the radiator.

15. The vehicle of claim 14, further comprising:

a second conduit; wherein the reserve tank comprises a vent;

the second conduit is attached to the vent; and the reserve tank and the legs are integrally formed from a polymeric material.

16. The vehicle of claim 12, further comprising:

at least one front wheel suspended from the frame and rotatable relative to the frame;

at least one rear wheel suspended from the frame and rotatable relative to the frame; and a source of motive power coupled to at least one of the at least one front wheel and the at least one rear wheel; wherein the cooling system operably facilitates cooling the source of motive power.

* * * * *